US009675148B2

(12) United States Patent
Yuan et al.

(10) Patent No.: US 9,675,148 B2
(45) Date of Patent: Jun. 13, 2017

(54) EXTENDABLE, UNIVERSAL CASE FOR PORTABLE ELECTRONIC DEVICES

(71) Applicant: Targus International LLC, Anaheim, CA (US)

(72) Inventors: Jonny Yuan, Placentia, CA (US); Alex Robert Cabunoc, Torrance, CA (US); Colin D. Greenidge, Thousand Oaks, CA (US)

(73) Assignee: Targus International LLC, Anaheim, CA (US)

( * ) Notice: Subject to any disclaimer, the term of this patent is extended or adjusted under 35 U.S.C. 154(b) by 0 days.

(21) Appl. No.: 15/067,789

(22) Filed: Mar. 11, 2016

(65) Prior Publication Data

US 2016/0270498 A1 Sep. 22, 2016

Related U.S. Application Data

(60) Provisional application No. 62/134,732, filed on Mar. 18, 2015, provisional application No. 62/201,399, filed on Aug. 5, 2015.

(51) Int. Cl.
*A45C 11/00* (2006.01)
*A45F 5/00* (2006.01)

(52) U.S. Cl.
CPC ..... *A45C 11/00* (2013.01); *A45F 5/00* (2013.01); *A45C 2011/002* (2013.01); *A45C 2011/003* (2013.01)

(58) Field of Classification Search
CPC ..... A45C 11/00; A45C 2011/002; A45C 2011/003; A45C 2011/001; A45F 5/00
USPC ..... 206/320; 361/679.55, 679.56, 679.3
See application file for complete search history.

(56) References Cited

U.S. PATENT DOCUMENTS

| | | | |
|---|---|---|---|
| 556,526 | A | 3/1896 | Baker |
| 910,619 | A | 1/1909 | Weidemann |
| 1,046,843 | A | 12/1912 | Olpp |
| 1,121,422 | A | 12/1914 | Tydings |
| 1,372,126 | A | 3/1921 | Dunham, Jr. |
| 1,374,126 | A | 4/1921 | Walter |
| 1,416,465 | A | 5/1922 | Harvey |
| 1,444,112 | A | 2/1923 | Davis |

(Continued)

FOREIGN PATENT DOCUMENTS

| | | | |
|---|---|---|---|
| CA | 2 785 813 | A1 | 12/2011 |
| CA | 2 758 982 | A1 | 5/2012 |

(Continued)

OTHER PUBLICATIONS

Non-Final Office Action for U.S. Appl. No. 14/874,980, filed Oct. 5, 2015, and mailed from the USPTO on Jul. 15, 2016, 9 pgs.

(Continued)

*Primary Examiner* — Steven A. Reynolds
(74) *Attorney, Agent, or Firm* — John R. Thompson; Stoel Rives LLP

(57) ABSTRACT

The present disclosure describes a case for portable electronic devices. According to various embodiments, a case may be capable of extending to accommodate different portable electronic devices. A discrete series of grooves within the case may provide the case with additional elasticity. A pattern of tessellations within the case may provide the case with additional elasticity. The increased elasticity may allow the case to be configured to frictionally engage and retain various portable electronic devices with slightly different physical dimensions.

11 Claims, 7 Drawing Sheets

(56) References Cited

U.S. PATENT DOCUMENTS

| | | | |
|---|---|---|---|
| 1,556,352 | A | 10/1925 | Ritter |
| 1,658,174 | A | 2/1928 | Russell |
| 1,721,427 | A | 7/1929 | Aldrich |
| 1,826,976 | A | 10/1931 | Wright |
| 1,889,765 | A | 12/1932 | Switkes |
| 2,018,605 | A | 10/1935 | Craig |
| 2,083,029 | A | 6/1937 | Lowy |
| 2,110,163 | A | 3/1938 | Lobel |
| 2,170,841 | A | 8/1939 | Thies et al. |
| 2,181,587 | A | 11/1939 | Plotkin |
| 2,316,328 | A | 4/1943 | Guenther et al. |
| 2,335,779 | A | 11/1943 | Mazzei |
| 2,503,746 | A | 4/1950 | Klehr |
| 2,554,215 | A | 5/1951 | Schell et al. |
| 2,556,066 | A | 6/1951 | Cline |
| 2,574,146 | A | 11/1951 | Gottesman |
| 2,589,438 | A | 3/1952 | Schneider |
| 2,653,709 | A | 9/1953 | Cunningham et al. |
| 2,681,142 | A | 6/1954 | Cohen |
| 2,696,322 | A | 12/1954 | Densen |
| 2,700,460 | A | 1/1955 | Hoover |
| 2,700,518 | A | 1/1955 | Ryno et al. |
| 2,708,989 | A | 5/1955 | Bogdanski |
| 2,769,474 | A | 11/1956 | Klotz |
| 2,771,167 | A | 11/1956 | Lifton |
| 2,771,184 | A | 11/1956 | Ryno et al. |
| 2,785,795 | A | 3/1957 | Ryno et al. |
| 2,800,940 | A | 7/1957 | Riesebeck |
| 2,837,208 | A | 6/1958 | Lingenfelter |
| 2,908,362 | A | 10/1959 | Burtchaell |
| 2,913,080 | A | 11/1959 | Louik et al. |
| D188,582 | S | 8/1960 | Koffler |
| 3,023,794 | A | 3/1962 | Lifton |
| 3,023,868 | A | 3/1962 | Koffler |
| 3,081,807 | A | 3/1963 | Lightburn |
| 3,115,228 | A | 12/1963 | Louik et al. |
| 3,115,229 | A | 12/1963 | Erhard |
| 3,136,413 | A | 6/1964 | Hall |
| 3,176,742 | A | 4/1965 | Kubnick |
| 3,185,198 | A | 5/1965 | Bryan |
| 3,192,978 | A | 7/1965 | Horvath |
| 3,265,168 | A | 8/1966 | Erhard |
| 3,286,751 | A | 11/1966 | Dishart |
| 3,292,778 | A | 12/1966 | Enderle |
| 3,412,521 | A | 11/1968 | Bauman |
| 3,441,072 | A | 4/1969 | Schmitt |
| 3,497,041 | A | 2/1970 | SamHammer |
| 3,500,973 | A | 3/1970 | Bush |
| 3,529,317 | A | 9/1970 | Schwarzkopf |
| 3,530,213 | A | 9/1970 | Isle |
| 3,531,822 | A | 10/1970 | Bush |
| 3,575,781 | A | 4/1971 | Pezely |
| 3,620,149 | A | 11/1971 | Ogihara |
| 3,656,594 | A | 4/1972 | Marks et al. |
| 3,692,155 | A | 9/1972 | Laurita |
| 3,698,404 | A | 10/1972 | Greco |
| 3,752,301 | A | 8/1973 | Bluemel |
| D230,376 | S | 2/1974 | Andrew |
| 3,813,729 | A | 6/1974 | Szabo et al. |
| 3,853,220 | A | 12/1974 | Luray |
| 3,912,055 | A | 10/1975 | Malooly |
| 3,912,140 | A | 10/1975 | Franges |
| 3,944,033 | A | 3/1976 | Simson |
| 3,949,879 | A | 4/1976 | Peterson et al. |
| 4,013,170 | A | 3/1977 | Hutterer |
| 4,044,867 | A | 8/1977 | Fisher |
| 4,106,597 | A | 8/1978 | Shook et al. |
| 4,114,761 | A | 9/1978 | Kleiner |
| 4,117,933 | A | 10/1978 | Lachance |
| 4,141,401 | A | 2/1979 | Hindemit |
| 4,189,037 | A | 2/1980 | Szabo |
| 4,212,377 | A | 7/1980 | Weinreb |
| 4,213,520 | A | 7/1980 | Sarna et al. |
| 4,259,568 | A | 3/1981 | Dynesen |
| 4,261,078 | A | 4/1981 | Edwards et al. |
| 4,336,883 | A | 6/1982 | Krug et al. |
| 4,339,039 | A | 7/1982 | Mykleby |
| 4,340,990 | A | 7/1982 | Seynhaeve |
| 4,364,150 | A | 12/1982 | Remington |
| 4,378,866 | A | 4/1983 | Pelavin |
| 4,433,781 | A | 2/1984 | Hummel |
| 4,478,450 | A | 10/1984 | Picozza |
| 4,514,876 | A | 5/1985 | Houlberg |
| 4,569,082 | A | 2/1986 | Ainsworth et al. |
| 4,573,202 | A | 2/1986 | Lee |
| 4,620,633 | A | 11/1986 | Lookholder |
| 4,651,872 | A | 3/1987 | Joyce |
| 4,655,418 | A | 4/1987 | Melahn |
| 4,658,298 | A | 4/1987 | Takeda et al. |
| 4,664,254 | A | 5/1987 | Sitwell et al. |
| 4,685,570 | A | 8/1987 | Medow |
| 4,685,571 | A | 8/1987 | Hoss |
| 4,700,832 | A | 10/1987 | Champ |
| 4,703,161 | A | 10/1987 | McLean |
| 4,707,883 | A | 11/1987 | Irani et al. |
| 4,722,376 | A | 2/1988 | Rhyner |
| 4,735,320 | A | 4/1988 | Hoss |
| D297,187 | S | 8/1988 | Kaczmarek |
| 4,762,227 | A | 8/1988 | Patterson |
| 4,817,769 | A | 4/1989 | Saliba |
| 4,828,081 | A | 5/1989 | Nordstrom et al. |
| 4,837,590 | A | 6/1989 | Sprague |
| 4,854,732 | A | 8/1989 | Italici |
| 4,874,093 | A | 10/1989 | Pharo |
| 4,901,897 | A | 2/1990 | Briggs et al. |
| 4,907,633 | A | 3/1990 | Eckstein |
| 4,919,240 | A | 4/1990 | Tobias |
| 4,946,036 | A | 8/1990 | Kupersmith |
| 4,991,328 | A | 2/1991 | Rousseau et al. |
| 5,010,988 | A | 4/1991 | Brown |
| 5,024,328 | A | 6/1991 | Bontrager |
| 5,031,763 | A | 7/1991 | Lynam |
| 5,056,665 | A | 10/1991 | Boecker et al. |
| 5,105,338 | A | 4/1992 | Held |
| 5,105,920 | A | 4/1992 | Grebenstein |
| 5,128,829 | A | 7/1992 | Loew |
| 5,129,519 | A | 7/1992 | David et al. |
| 5,150,776 | A | 9/1992 | Rebenack |
| 5,160,001 | A | 11/1992 | Marceau |
| 5,165,649 | A | 11/1992 | Neumann et al. |
| 5,207,327 | A | 5/1993 | Brondos |
| 5,210,904 | A | 5/1993 | Pratt |
| 5,211,290 | A | 5/1993 | Janus et al. |
| 5,217,119 | A | 6/1993 | Hollingsworth |
| 5,221,005 | A | 6/1993 | Hayward |
| 5,226,542 | A | 7/1993 | Boecker et al. |
| 5,249,653 | A | 10/1993 | King |
| 5,251,102 | A | 10/1993 | Kimble |
| 5,330,049 | A | 7/1994 | Bertelsen et al. |
| 5,341,929 | A | 8/1994 | Stefancin, Jr. |
| 5,348,347 | A | 9/1994 | Shink |
| 5,356,004 | A | 10/1994 | Weinreb |
| 5,375,076 | A | 12/1994 | Goodrich et al. |
| D356,120 | S | 3/1995 | Allen |
| 5,402,892 | A | 4/1995 | Jaszai |
| D357,918 | S | 5/1995 | Doria |
| 5,445,266 | A | 8/1995 | Prete et al. |
| 5,469,945 | A | 11/1995 | Jserng |
| 5,480,118 | A | 1/1996 | Cross |
| 5,494,157 | A | 2/1996 | Golenz et al. |
| 5,524,754 | A | 6/1996 | Hollingsworth |
| 5,544,792 | A | 8/1996 | Arnwine |
| 5,555,157 | A | 9/1996 | Moller et al. |
| 5,555,960 | A | 9/1996 | Bartsch |
| 5,594,619 | A | 1/1997 | Miyagawa et al. |
| 5,607,054 | A | 3/1997 | Hollingsworth |
| 5,622,262 | A | 4/1997 | Sadow |
| 5,624,035 | A | 4/1997 | Kim |
| 5,629,833 | A | 5/1997 | Ido et al. |
| 5,676,223 | A | 10/1997 | Cunningham |
| 5,676,509 | A | 10/1997 | Enzu |
| 5,678,666 | A | 10/1997 | Shyr et al. |
| 5,706,935 | A | 1/1998 | Lorton |
| 5,708,561 | A | 1/1998 | Huilgol et al. |

(56) References Cited

U.S. PATENT DOCUMENTS 5,725,090 A 3/1998 Vermillion et al.
5,735,397 A 4/1998 Cyr
5,755,329 A 5/1998 Sadow
5,762,170 A 6/1998 Shyr et al.
5,765,688 A 6/1998 Bertram et al.
5,769,221 A 6/1998 Cyr
5,769,231 A 6/1998 Batsford
5,769,232 A 6/1998 Cash et al.
5,775,496 A 7/1998 Cyr
5,775,497 A 7/1998 Krulik
5,788,032 A 8/1998 Krulik
5,797,044 A 8/1998 Lawther et al.
5,808,865 A 9/1998 Alves
5,819,942 A 10/1998 Sadow
5,826,770 A 10/1998 Chuang
5,829,099 A 11/1998 Kopelman et al.
5,833,352 A 11/1998 Goodwin
D403,151 S 12/1998 Heredos-Formby
5,857,568 A 1/1999 Speirs
5,881,850 A 3/1999 Murdoch
5,884,768 A 3/1999 Fox
5,887,723 A 3/1999 Myles et al.
5,887,777 A 3/1999 Myles et al.
5,908,147 A 6/1999 Chuang
5,909,759 A 6/1999 Tanaka et al.
5,909,806 A 6/1999 Fischel et al.
5,954,170 A 9/1999 Chisholm
5,960,952 A 10/1999 Chen
5,967,270 A 10/1999 Shyr
5,971,148 A 10/1999 Jackson
5,996,180 A 12/1999 Eisenzopf
5,996,778 A 12/1999 Shih
6,024,054 A 2/2000 Matt et al.
6,059,079 A 5/2000 Krulik
6,062,356 A 5/2000 Nykoluk
6,062,357 A 5/2000 Bogert
6,073,770 A 6/2000 Park
6,082,543 A 7/2000 Béliveau
6,098,768 A 8/2000 Tsai
6,105,763 A 8/2000 Saetia
6,105,764 A 8/2000 Scicluna et al.
6,105,766 A 8/2000 Chuang
6,109,434 A 8/2000 Howard, Jr.
6,131,734 A 10/2000 Hollingsworth et al.
6,145,337 A 11/2000 Wilson
6,145,661 A 11/2000 Jung
6,173,933 B1 1/2001 Whiteside et al.
6,179,431 B1 1/2001 Chien
6,193,118 B1 2/2001 Kearl
6,213,266 B1 4/2001 Hollingsworth
6,213,267 B1 4/2001 Miller
6,227,339 B1 5/2001 Bogert
6,237,766 B1 5/2001 Hollingsworth
6,257,407 B1 7/2001 Truwit et al.
6,286,645 B1 9/2001 Chen
6,295,650 B1 10/2001 Baacke
6,318,552 B1 11/2001 Godshaw
6,334,533 B1 1/2002 Hollingsworth et al.
6,334,534 B1 1/2002 Hollingsworth et al.
6,338,180 B1 1/2002 Massard
D453,749 S 2/2002 Lee et al.
6,354,477 B1 3/2002 Trummer
6,360,402 B1 3/2002 Crabtree
6,390,297 B1 5/2002 Hollingsworth
6,439,389 B1 8/2002 Mogil
6,494,321 B1 12/2002 Sadow et al.
6,499,187 B2 12/2002 Hollingsworth et al.
6,535,199 B1 3/2003 Canova, Jr. et al.
D476,149 S 6/2003 Andre et al.
6,616,111 B1 9/2003 White
6,629,588 B2 10/2003 Nykoluk et al.
6,687,955 B2 2/2004 Hollingsworth
6,746,638 B1 6/2004 Zadesky et al.
6,772,879 B1 8/2004 Domotor
6,785,566 B1 8/2004 Irizarry
D500,923 S 1/2005 Gonzalez et al.
6,856,506 B2 2/2005 Doherty et al.
6,925,739 B1 8/2005 Cole et al.
D513,008 S 12/2005 Takizawa et al.
7,048,103 B2 5/2006 Hollingsworth
D527,176 S 8/2006 Andre et al.
D529,717 S 10/2006 Brancky
D533,348 S 12/2006 Andre et al.
7,207,154 B2 4/2007 Araujo
D541,646 S 5/2007 Hayes et al.
7,216,763 B2 5/2007 Gormick et al.
7,281,698 B2 10/2007 Patterson, Jr.
D574,375 S 8/2008 Prest et al.
D574,819 S 8/2008 Andre et al.
7,414,833 B2 8/2008 Kittayapong
7,451,872 B1 11/2008 Allen
D582,405 S 12/2008 Andre et al.
7,467,695 B2 12/2008 Gormick et al.
7,495,895 B2 2/2009 Carnevali
7,500,561 B2 3/2009 Matias et al.
7,503,440 B2 3/2009 Gormick et al.
D593,528 S 6/2009 Shi
D600,699 S 9/2009 Johnston et al.
7,652,873 B2 1/2010 Lee
D610,111 S 2/2010 Kim et al.
7,735,644 B2 6/2010 Sirichai et al.
7,747,007 B2 6/2010 Hyun et al.
D619,554 S 7/2010 Kim et al.
D623,404 S 9/2010 Andre et al.
D623,638 S 9/2010 Richardson et al.
D623,639 S 9/2010 Richardson et al.
D628,197 S 11/2010 Li
7,835,145 B2 11/2010 Chiang et al.
D629,772 S 12/2010 Mo et al.
7,876,550 B1 1/2011 Albertini et al.
D637,814 S 5/2011 Akana et al.
D643,396 S 8/2011 Hou
8,016,107 B2 9/2011 Emsky
D649,539 S 11/2011 Hong
8,051,980 B2 11/2011 Tai et al.
D655,287 S 3/2012 de Jong et al.
8,132,670 B1 3/2012 Chen
D658,186 S 4/2012 Akana et al.
D658,187 S 4/2012 Diebel
D658,188 S 4/2012 Diebel
D658,363 S 5/2012 Biddle
8,173,893 B2 5/2012 Huang
8,201,687 B2 6/2012 Zeliff et al.
D663,304 S 7/2012 Akana et al.
8,230,992 B2 7/2012 Law et al.
D665,812 S 8/2012 Huang et al.
8,235,208 B2 8/2012 Sirichai et al.
8,253,518 B2 8/2012 Lauder et al.
D669,480 S 10/2012 Piedra et al.
8,281,924 B2 10/2012 Westrup
8,281,950 B2 10/2012 Potts et al.
8,282,065 B1 10/2012 Stone
8,312,991 B2 11/2012 Diebel et al.
D672,353 S 12/2012 Liu
D672,739 S 12/2012 Sin
D672,781 S 12/2012 Lu
8,328,008 B2 12/2012 Diebel et al.
D675,625 S 2/2013 Hasbrook et al.
D676,871 S 2/2013 Antonio
D678,259 S 3/2013 Moore et al.
D678,292 S 3/2013 Phillips et al.
D678,327 S 3/2013 Lee et al.
8,393,464 B2 3/2013 Yang et al.
8,395,465 B2 3/2013 Lauder et al.
D679,279 S 4/2013 Yang et al.
D679,685 S 4/2013 Cox
D679,692 S 4/2013 Fahrendorff et al.
D679,694 S 4/2013 Fahrendorff et al.
D682,836 S 5/2013 Akana et al.
D684,567 S 6/2013 Murchison et al.
8,457,701 B2 6/2013 Diebel
8,459,453 B2 6/2013 Parker et al.
8,467,183 B2 6/2013 Probst et al.
D685,357 S 7/2013 Rekuc et al.

(56) References Cited

U.S. PATENT DOCUMENTS

| | | | |
|---|---|---|---|
| D685,740 | S | 7/2013 | Moore et al. |
| D686,606 | S | 7/2013 | Hong |
| D686,607 | S | 7/2013 | Hong |
| 8,474,609 | B1 | 7/2013 | Hong et al. |
| D687,425 | S | 8/2013 | Fahrendorff et al. |
| D689,501 | S | 9/2013 | Fong |
| 8,542,480 | B2 | 9/2013 | Williams et al. |
| D691,601 | S | 10/2013 | Murchison et al. |
| D691,611 | S | 10/2013 | Kirzinger |
| D692,418 | S | 10/2013 | Fahrendorff et al. |
| 8,544,639 | B2 | 10/2013 | Yang et al. |
| 8,567,578 | B2 | 10/2013 | Cuong et al. |
| 8,573,394 | B2 | 11/2013 | Ahee et al. |
| 8,584,847 | B2 | 11/2013 | Tages et al. |
| D695,729 | S | 12/2013 | Shi et al. |
| D696,253 | S | 12/2013 | Akana et al. |
| D696,256 | S | 12/2013 | Piedra et al. |
| D696,670 | S | 12/2013 | Schiller et al. |
| 8,720,843 | B1 | 5/2014 | Chen |
| 8,724,300 | B2 | 5/2014 | Smith et al. |
| 8,746,449 | B2 | 6/2014 | Gallagher et al. |
| D709,484 | S | 7/2014 | Yoo |
| 8,763,795 | B1 | 7/2014 | Oten et al. |
| 8,783,458 | B2 | 7/2014 | Gallagher et al. |
| 8,887,910 | B2 | 11/2014 | Ashley et al. |
| 8,905,231 | B2 | 12/2014 | Couch, III et al. |
| 8,925,722 | B2 | 1/2015 | Poon et al. |
| 9,110,630 | B2 | 8/2015 | Cakir et al. |
| 9,170,611 | B2 | 10/2015 | Gallagher et al. |
| 9,314,078 | B1 | 4/2016 | Haymond et al. |
| 2001/0014010 | A1 | 8/2001 | Jenks et al. |
| 2001/0042665 | A1 | 11/2001 | Siwak |
| 2001/0052710 | A1 | 12/2001 | Witherell |
| 2002/0000390 | A1 | 1/2002 | Hollingsworth |
| 2002/0027052 | A1 | 3/2002 | Godshaw et al. |
| 2002/0179470 | A1 | 12/2002 | Lee |
| 2003/0042091 | A1 | 3/2003 | Oh |
| 2003/0132132 | A1 | 7/2003 | Small |
| 2003/0183679 | A1 | 10/2003 | Ong |
| 2003/0186729 | A1 | 10/2003 | Engstrom et al. |
| 2004/0018863 | A1 | 1/2004 | Engstrom et al. |
| 2004/0134812 | A1 | 7/2004 | Yeh |
| 2004/0217027 | A1 | 11/2004 | Harris et al. |
| 2004/0224732 | A1 | 11/2004 | Lee et al. |
| 2004/0226793 | A1 | 11/2004 | Tilby |
| 2004/0240164 | A1 | 12/2004 | Lee |
| 2005/0057893 | A1 | 3/2005 | Homer et al. |
| 2005/0105264 | A1 | 5/2005 | Chen |
| 2005/0237701 | A1 | 10/2005 | Yu |
| 2006/0007645 | A1 | 1/2006 | Chen et al. |
| 2006/0052064 | A1 | 3/2006 | Goradesky |
| 2006/0144662 | A1 | 7/2006 | Hu |
| 2006/0226040 | A1 | 10/2006 | Medina |
| 2007/0001079 | A1 | 1/2007 | Patterson, Jr. |
| 2007/0051645 | A1 | 3/2007 | Hassett |
| 2007/0056865 | A1 | 3/2007 | Pelo |
| 2007/0057140 | A1 | 3/2007 | Liou et al. |
| 2007/0119734 | A1 | 5/2007 | Pichahchi |
| 2007/0166028 | A1 | 7/2007 | Kranz et al. |
| 2007/0205122 | A1 | 9/2007 | Oda et al. |
| 2007/0279855 | A1 | 12/2007 | Linsmeier et al. |
| 2008/0029412 | A1 | 2/2008 | Ho et al. |
| 2008/0037213 | A1 | 2/2008 | Haren |
| 2008/0043411 | A1 | 2/2008 | Chih et al. |
| 2008/0045279 | A1 | 2/2008 | Ohki |
| 2008/0055835 | A1 | 3/2008 | Kumano et al. |
| 2008/0226286 | A1 | 9/2008 | Huang |
| 2008/0237432 | A1 | 10/2008 | Patterson |
| 2008/0251339 | A1 | 10/2008 | Williams |
| 2008/0302687 | A1 | 12/2008 | Sirichai et al. |
| 2009/0073337 | A1 | 3/2009 | Liou et al. |
| 2009/0109558 | A1 | 4/2009 | Schaefer |
| 2009/0127423 | A1 | 5/2009 | Chen et al. |
| 2009/0139814 | A1 | 6/2009 | Grossman et al. |
| 2009/0178938 | A1 | 7/2009 | Palmer |
| 2009/0194209 | A1 | 8/2009 | DeFilippis et al. |
| 2009/0205985 | A1 | 8/2009 | Freeman et al. |
| 2009/0223765 | A1 | 9/2009 | Bosma |
| 2009/0223845 | A1 | 9/2009 | Bosma et al. |
| 2009/0229936 | A1 | 9/2009 | Cuong et al. |
| 2009/0230006 | A1 | 9/2009 | Pidgley et al. |
| 2009/0238335 | A1 | 9/2009 | Ripp et al. |
| 2009/0294235 | A1 | 12/2009 | Santy et al. |
| 2010/0044259 | A1 | 2/2010 | Wang |
| 2010/0072334 | A1 | 3/2010 | Le Gette et al. |
| 2010/0082445 | A1 | 4/2010 | Hodge et al. |
| 2010/0101975 | A1 | 4/2010 | Zhang et al. |
| 2010/0116710 | A1 | 5/2010 | Huang et al. |
| 2010/0225429 | A1 | 9/2010 | Tsai |
| 2010/0232102 | A1 | 9/2010 | Walker et al. |
| 2010/0258602 | A1 | 10/2010 | Amin |
| 2010/0277858 | A1 | 11/2010 | Zhou |
| 2010/0294683 | A1 | 11/2010 | Mish et al. |
| 2010/0294909 | A1 | 11/2010 | Hauser et al. |
| 2011/0034221 | A1 | 2/2011 | Hung et al. |
| 2011/0090626 | A1 | 4/2011 | Hoellwarth et al. |
| 2011/0221319 | A1 | 9/2011 | Law et al. |
| 2011/0240448 | A1 | 10/2011 | Springer et al. |
| 2011/0284420 | A1 | 11/2011 | Sajid |
| 2011/0290687 | A1 | 12/2011 | Han |
| 2011/0297566 | A1 | 12/2011 | Gallagher et al. |
| 2011/0297581 | A1 | 12/2011 | Angel |
| 2011/0298345 | A1 | 12/2011 | Shortt et al. |
| 2011/0315579 | A1 | 12/2011 | Mase |
| 2011/0315589 | A1 | 12/2011 | Thomas |
| 2012/0012483 | A1 | 1/2012 | Fan |
| 2012/0024918 | A1 | 2/2012 | DeCamp et al. |
| 2012/0037285 | A1 | 2/2012 | Diebel et al. |
| 2012/0037523 | A1 | 2/2012 | Diebel et al. |
| 2012/0075789 | A1 | 3/2012 | DeCamp et al. |
| 2012/0112031 | A1 | 5/2012 | Gormick et al. |
| 2012/0176741 | A1 | 7/2012 | Wu et al. |
| 2012/0194448 | A1 | 8/2012 | Rothkopf |
| 2012/0217174 | A1 | 8/2012 | Ting |
| 2012/0224316 | A1 | 9/2012 | Shulenberger |
| 2012/0247991 | A1 | 10/2012 | Meehan |
| 2012/0261289 | A1 | 10/2012 | Wyner et al. |
| 2012/0298394 | A1 | 11/2012 | Huang |
| 2012/0325702 | A1 | 12/2012 | Gallagher et al. |
| 2013/0016467 | A1 | 1/2013 | Ku |
| 2013/0045782 | A1 | 2/2013 | Simmer |
| 2013/0048413 | A1 | 2/2013 | Patzer |
| 2013/0048514 | A1 | 2/2013 | Corcoran et al. |
| 2013/0048520 | A1 | 2/2013 | Garrett et al. |
| 2013/0063873 | A1 | 3/2013 | Wodrich et al. |
| 2013/0098788 | A1 | 4/2013 | McCarville et al. |
| 2013/0126365 | A1 | 5/2013 | Hung |
| 2013/0140194 | A1 | 6/2013 | Han |
| 2013/0163980 | A1 | 6/2013 | Lazaridis et al. |
| 2013/0170686 | A1 | 7/2013 | Lester, Jr. |
| 2013/0213838 | A1 | 8/2013 | Tsai et al. |
| 2013/0214661 | A1 | 8/2013 | McBroom |
| 2013/0241381 | A1 | 9/2013 | Hynecek et al. |
| 2013/0264459 | A1 | 10/2013 | McCosh et al. |
| 2013/0271922 | A1 | 10/2013 | Wilson et al. |
| 2013/0322660 | A1 | 12/2013 | Weiss |
| 2014/0008248 | A1 | 1/2014 | Thoni |
| 2014/0069825 | A1 | 3/2014 | Macrina et al. |
| 2014/0216954 | A1 | 8/2014 | Law et al. |
| 2014/0246340 | A1 | 9/2014 | Jiang et al. |
| 2014/0262853 | A1 | 9/2014 | DeChant |
| 2014/0291175 | A1 | 10/2014 | Chung et al. |
| 2014/0291176 | A1 | 10/2014 | Chung |

FOREIGN PATENT DOCUMENTS

| | | | |
|---|---|---|---|
| CA | 2 827 491 | A1 | 9/2012 |
| DE | 4234581 | | 4/1993 |
| DE | 20 2010 010 388 | U1 | 1/2011 |
| EP | 797939 | A2 | 1/1997 |
| EP | 797939 | A3 | 7/1998 |
| EP | 1 548 544 | A2 | 6/2005 |
| EP | 2 392 986 | A2 | 12/2011 |
| EP | 2 426 571 | A2 | 3/2012 |

(56) References Cited

FOREIGN PATENT DOCUMENTS

| | | | |
|---|---|---|---|
| EP | 2 564 722 | A1 | 3/2013 |
| EP | 2 638 823 | A1 | 9/2013 |
| EP | 2 337 373 | B1 | 12/2013 |
| FR | 2391668 | A | 12/1978 |
| GB | 146601 | | 7/1920 |
| GB | 161117 | | 4/1921 |
| GB | 2 402 869 | A | 12/2004 |
| GB | 2464583 | B | 7/2010 |
| GB | 2495330 | A | 4/2013 |
| GB | 2496109 | A | 5/2013 |
| JP | 135796 | | 11/1978 |
| JP | 3222728 | | 10/1991 |
| JP | H073344 | U | 1/1995 |
| JP | 09135722 | A | 5/1997 |
| JP | 11299521 | A | 11/1999 |
| JP | 2000014426 | A | 1/2000 |
| JP | 2000217622 | A | 8/2000 |
| JP | 2003230417 | A | 8/2003 |
| JP | 2004509680 | A | 4/2004 |
| JP | 2004231158 | A | 8/2004 |
| JP | 2006024178 | A | 1/2006 |
| KR | 100362369 | B1 | 11/2002 |
| KR | 20080075716 | B | 8/2008 |
| KR | 10-1264668 | B1 | 5/2013 |
| KR | 10-2013-0081622 | | 11/2013 |
| MY | WO 2010/036090 | A2 | 4/2010 |
| SU | 1638073 | | 3/1991 |
| WO | 9207372 | A1 | 4/1992 |
| WO | WO 01/90848 | A2 | 11/2001 |
| WO | WO 2011/115918 | A1 | 9/2011 |
| WO | WO 2011/130157 | A2 | 10/2011 |
| WO | WO 2011/156275 | A2 | 12/2011 |
| WO | WO 2012/112790 | A2 | 8/2012 |
| WO | WO 2013/058938 | A1 | 4/2013 |
| WO | WO 2013/096633 | A1 | 6/2013 |
| WO | WO 2013/103928 | A1 | 7/2013 |
| WO | WO 2013/126216 | A1 | 8/2013 |
| WO | WO 2013/128675 | A1 | 9/2013 |
| WO | WO 2013/188319 | A1 | 12/2013 |

OTHER PUBLICATIONS

Office Action for U.S. Appl. No. 12/370,824, filed Feb. 13, 2009, and mailed from the USPTO on May 20, 2013, 22 pgs.
Office Action for U.S. Appl. No. 13/791,445, filed Mar. 8, 2013, and mailed from the USPTO on Jun. 21, 2013, 20 pgs.
Third-Party Submission Under 37 CFR 1.290 Concise Description of Relevance, for U.S. Appl. No. 13/791,445, filed by Raymond Meiers in Ohio on Jul. 31, 2013, 14 pgs.
Notice of Allowance and Fee(s) Due for U.S. Appl. No. 12/370,824, filed Feb. 13, 2009, and mailed from the USTPO on Sep. 9, 2013, 12 pgs.
Office Action for U.S. Appl. No. 13/747,992, filed Jan. 23, 2013, and mailed from the USPTO on Oct. 23, 2013, 21 pgs.
Final Office Action for U.S. Appl. No. 13/791,445, filed Mar. 8, 2013, and mailed from the USPTO on Oct. 23, 2013, 21 pgs.
Final Office Action for U.S. Appl. No. 13/171,225, filed Jun. 28, 2011, and mailed from the USPTO on Dec. 4, 2013, 17 pgs.
Non-Final Office Action for U.S. Appl. No. 13/791,445, filed Mar. 8, 2013, and mailed from the USPTO on Dec. 27, 2013, 8 pgs.
Office Action for U.S. Appl. No. 13/739,846, filed Jan. 11, 2013, and mailed on Feb. 27, 2014, 19 pgs.
Non-final Office Action for U.S. Appl. No. 14/099,436, filed Dec. 6, 2013, and mailed from the USPTO on Mar. 26, 2014, 18 pgs.
Notice of Allowance and Fee(s) Due for U.S. Appl. No. 29/431,992, filed Sep. 12, 2012, and mailed from the USPTO on Apr. 2, 2014, 27 pgs.
Office Action for U.S. Appl. No. 13/791,445, filed Mar. 8, 2013, and mailed from the USPTO on Apr. 10, 2014, 9 pgs.
Notice of Allowance and Fee(s) Due for U.S. Appl. No. 13/747,992, filed Jan. 23, 2013, and mailed from the USPTO on Apr. 16, 2014, 10 pgs.
Notice of Allowance and Fee(s) Due for U.S. Appl. No. 13/791,445, filed Mar. 8, 2013, and mailed from the USPTO on Apr. 25, 2014, 8 pgs.
Office Action for U.S. Appl. No. 29/454,936, filed May 15, 2013, and mailed from the USPTO May 5, 2014, 22 pgs.
Office Action for U.S. Appl. No. 29/454,913, filed May 15, 2013, and mailed from the USPTO on May 7, 2014, 23 pgs.
Office Action for U.S. Appl. No. 29/454,934, filed May 15, 2013, and mailed from the USPTO on May 7, 2014, 23 pgs.
Notice of Allowance and Fee(s) Due for U.S. Appl. No. 14/099,436, filed Dec. 6, 2013, and mailed from the USPTO on May 13, 2014, 9 pgs.
Notice of Allowance and Fee(s) Due for U.S. Appl. No. 29/452,310, filed Apr. 15, 2013, and mailed from the USPTO on Sep. 25, 2014, 27 pgs.
Non-Final Office Action for U.S. Appl. No. 13/155,266, filed Jun. 7, 2011, and mailed from the USPTO on Nov. 6, 2014, 35 pgs.
Non-Final Office Action for U.S. Appl. No. 13/937,027, filed Jul. 8, 2013, and mailed from the USPTO on Feb. 3, 2015, 37 pgs.
Non-Final Office Action for U.S. Appl. No. 14/020,298, filed Sep. 6, 2013, and mailed from the USPTO on Feb. 12, 2015, 35 pgs.
Non-Final Office Action for U.S. Appl. No. 14/341,149, filed Jul. 25, 2014, and mailed from the USPTO on Apr. 21, 2015, 25 pgs.
Notice of Allowance and Fee(s) Due for U.S. Appl. No. 13/155,266, filed Jun. 7, 2011, and mailed from the USPTO on May 15, 2015, 8 pgs.
Notice of Allowance and Fee(s) Due for U.S. Appl. No. 14/341,149, filed Jul. 25, 2014, and mailed from the USPTO on Jul. 8, 2015, 8 pgs.
MacWorld, "PortTM: the best cradle for your powerbook," Apr. 1993.
Office Action for U.S. Appl. No. 10/939,333, filed Sep. 14, 2004, and mailed from the USPTO on Apr. 7, 2008, 15 pgs.
Office Action for U.S. Appl. No. 10/939,346, filed Sep. 14, 2004, and mailed from the USPTO on Apr. 8, 2008,14 pgs.
International Searching Authority, International Search Report and Written Opinion of PCT/US2011/039287, mailed Dec. 28, 2011.
Office Action for U.S. Appl. No. 13/308,192, filed Nov. 30, 2011, and mailed from the USPTO on Mar. 23, 2012, 14 pgs.
Office Action for U.S. Appl. No. 13/308,192, filed Nov. 30, 2011, and mailed from the USPTO on Aug. 27, 2012, 14 pgs.
Office Action for U.S. Appl. No. 12/370,824, filed Feb. 13, 2009, mailed from the USPTO on Aug. 2, 2012, 16 pgs.
International Preliminary Report on Patentability for PCT/US2011/039287 filed Jun. 6, 2011, and mailed Dec. 20, 2012, 7 pgs.
Office Action for U.S. Appl. No. 12/370,824, filed Feb. 13, 2009, and mailed from the USPTO on Jan. 4, 2013, 19 pgs.
Office Action for U.S. Appl. No. 13/171,225, filed Jun. 28, 2011, and mailed from the USPTO on Apr. 16, 2013, 24 pgs.
Office Action for U.S. Appl. No. 13/285,565, filed Oct. 31, 2011, and mailed from the USPTO on May 9, 2013, 11 pgs.
Tessellated iPhone 5 Case by NatureWorks—Thingiverse, retrieved from the Internet on May 31, 2016, http://www.thingiverse.com/thing:452098 published Sep. 4, 2014 as noted on the website, 1 pg.
International Search Report and Written Opinion for Application No. PCT/US2016/022033 filed Mar. 11, 2016, 13 pgs.
Non-Final Office Action for U.S. Appl. No. 13/601,799, filed Aug. 31, 2012, and mailed from the USPTO on Sep. 13, 2016, 49 pgs.
Non-Final Office Action for U.S. Appl. No. 14/720,093, filed May 22, 2015, and mailed from the USPTO on Feb. 22, 2017, 24 pgs.
Final Office Action for U.S. Appl. No. 13/601,799, filed Aug. 31, 2012, and mailed from the USPTO on Apr. 19, 2017, 18 pgs.
Non-Final Office Action for U.S. Appl. No. 15/255,580, filed Sep. 2, 2016, and mailed from the USPTO on Apr. 11, 2017, 29 pgs.

EXTENDABLE, UNIVERSAL CASE FOR PORTABLE ELECTRONIC DEVICES

RELATED APPLICATIONS

This application claims priority to U.S. Patent Application Ser. No. 62/134,732 filed on Mar. 18, 2015 and U.S. Patent Application Ser. No. 62/201,399 filed on Aug. 5, 2015, both of which are incorporated herein by reference.

TECHNICAL FIELD

This disclosure generally relates to cases for portable electronic devices.

BRIEF DESCRIPTION OF THE DRAWINGS

Non-limiting and non-exhaustive embodiments of the disclosure are described, including various embodiments of the disclosure with reference to the figures, in which.

Figure 1:
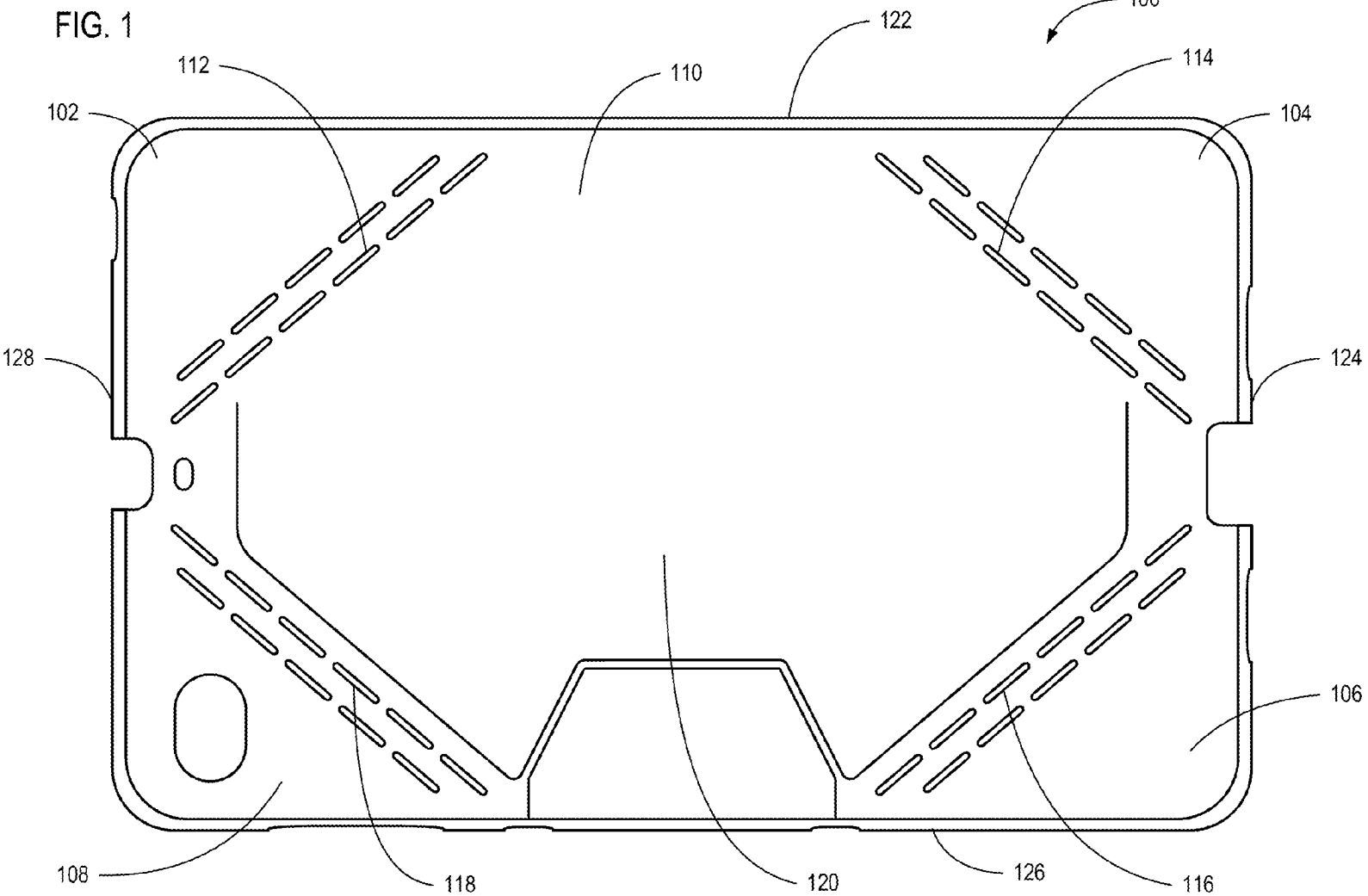
FIG. 1 is a rear view of an embodiment of a case with extendable corners.

In the following description, numerous specific details are provided for a thorough understanding of the various embodiments disclosed herein. The embodiments disclosed herein can be practiced without one or more of the specific details, or with other methods, components, materials, etc. In addition, in some cases, well-known structures, materials, or operations may not be shown or described in detail in order to avoid obscuring aspects of the disclosure. Furthermore, the described features, structures, or characteristics may be combined in any suitable manner in one or more alternative embodiments.

DETAILED DESCRIPTION

The present disclosure provides various embodiments of cases for securing and/or protecting portable electronic devices (PEDs). According to various embodiments, a case may be configured to secure PEDs having slightly different dimensions. This may accommodate the small physical variations typically observed when a manufacturer introduces an updated PED. For example, a single case may be configured to secure a first generation tablet device with a height of 9.5 inches, a width of 7.31 inches, and a depth of 0.37 inches, or a second generation tablet device with a height of 9.4 inches, a width of 6.6 inches, and a depth of 0.29 inches.

Such a case may comprise a body with a rear wall and a plurality of sidewalls coupled to the rear wall. These sidewalls and rear wall may be configured in size and shape to frictionally engage and retain a PED. The case may also have at least one discrete series of grooves in the rear wall. The discrete series of grooves may allow the rear wall to extend, and thus allow the case to accommodate slight variations in PED dimensions. In addition, the rear wall and sidewalls may be made of a material with a high elasticity coefficient further allowing the case to be stretch and accommodate tablets of different sizes.

A "portable electronic device" (PED) as used throughout the specification may include any of a wide variety of electronic devices. Specifically contemplated and illustrated are tablet-style electronic devices, including, but not limited to, electronic readers, tablet computers, tablet PCs, mini tablets, phablets, cellular phones (including smart phones), interactive displays, video displays, touch screens, touch computers, etc.

Additionally, any of a wide variety of materials and manufacturing methods may be used to produce the various components of the presently described case for portable electronic devices. For example, a case may utilize various plastics, rubbers, nylons, glasses, fabrics, leathers, and/or other suitable materials.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment.

The embodiments of the disclosure are described below with reference to the drawings, wherein like parts are designated by like numerals throughout. The components of the disclosed embodiments, as generally described and illustrated in the figures herein, could be arranged in and designed in a wide variety of different configurations. Furthermore, the features, structures, and operations associated with one embodiment may be applicable to or combined with the features, structures, or operations described in conjunction with another embodiment. In other instances, well-known structures, materials, or operations are not shown or described in detail to avoid obscuring aspects of this disclosure.

Thus, the following detailed description of the embodiments of the case is not intended to limit the scope of the disclosure, as claimed, but is merely representative of possible embodiments.

FIG. 1 is a rear view of an embodiment of a case 100 with extendable corners (i.e., first corner 102, second corner 104, third corner 106, and fourth corner 108). The case 100 may include a body 110, and several discrete series of grooves (e.g., first discrete series of grooves 112, second discrete series of grooves 114, third discrete series of grooves 116, and fourth discrete series of grooves 118). The grooves 112, 114, 116, and 118 may extend completely through the body 110. The grooves 112, 114, 116, and 118 may extend in a row equidistant from one another. The body 110 secures and/or protects PEDs while the discrete series of grooves 112, 114, 116, and 118 may selectively allow the corners 102, 104, 106, and 108 to extend. Thus, the case 100 may provide protection and/or support to PEDs with different dimensions by combing these elements.

The body 110 may include a rear wall 120 and sidewalls 122, 124, 126, 128. According to various embodiments, the rear wall 120 and sidewalls 122, 124, 126, 128 may provide protection for an encased PED. The rear wall 120 may comprise elastic materials to allow flexibility and stretchability. Other embodiments may include ornamental features, and may not even completely cover the backside of the PED. Yet other embodiments may have sidewalls composed of materials with a high elasticity coefficient. The stretchable sidewalls may assist in accommodating tablets of different sizes.

The body 110 may be configured to secure a variety of PEDs. The illustrated embodiment of the body 110 has a shape corresponding to a PED such that it engages the PED around its circumference to retain the PED in the case 100. Thus, the body 110 may use its sidewalls 122, 124, 126, 128 to secure a PED through a frictional engagement. Further, if the sidewalls 122, 124, 126, 128 have a high elasticity coefficient the sidewalls 122, 124, 126, 128 can have the ability to stretch and accommodate tablets of different sizes. The body 110 may use other mechanisms to secure the device such as elastics, magnets, adhesives, etc. The body 110 may secure a PED such that the backside and edges of the PED are substantially protected.

The discrete series of grooves may be in various positions. In one embodiment, the grooves are placed equidistant from one another in one or more rows. Thus, although two rows of grooves are shown, one, three or more rows may be utilized. As illustrated the discrete series or rows of grooves may be placed proximate to each corner and extend diagonally from the sidewalls. Alternatively, in another embodiment, the discrete series of grooves may be placed in parallel with the sidewalls.

Figure 2:
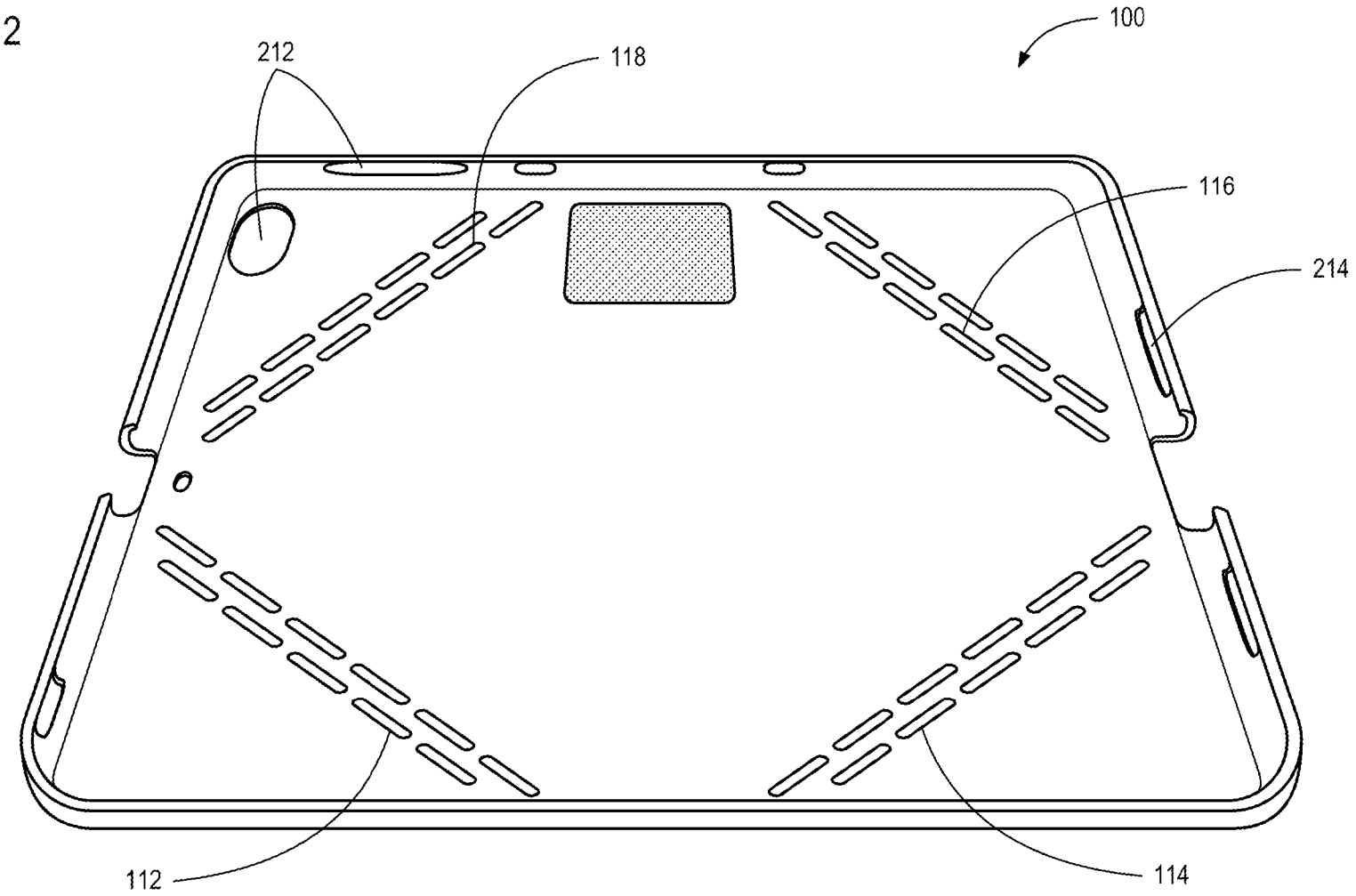
FIG. 2 is a front perspective view of an embodiment of a case with extendable corners.

FIG. 2 is a front perspective view of an embodiment of the case 100 with extendable corners. As shown, an embodiment of the body 110 may include a plurality of access points 212 for interacting with various elements of a PED. These elements vary by PED and may include, but are not limited to, a camera, USB port, headphone jack, power button, and volume rocker. Further, the body 110 may include a speaker grill 214 to prevent a PED's speaker from being muffled.

Further, the several discrete series of grooves (e.g., first discrete series of grooves 112, second discrete series of grooves 114, third discrete series of grooves 116, and fourth discrete series of grooves 118) may appear on the front of the case 100. For example, as illustrated, the discrete grooves 112, 114, 116, and 118 may have holes that extend completely through the body 110.

Another embodiment may have the discrete grooves 112, 114, 116, and 118 only partially extended into the body 110. For example, the discrete series grooves 112, 114, 116, and 118 may be shallow divots formed along the front of the case 100. In such an embodiment, the discrete grooves 112, 114, 116, and 118 would not appear on the back of the case 100. Another embodiment may have shallow divots along the back of the case 100 forming the discrete series of grooves 112, 114, 116, and 118.

Figure 3:
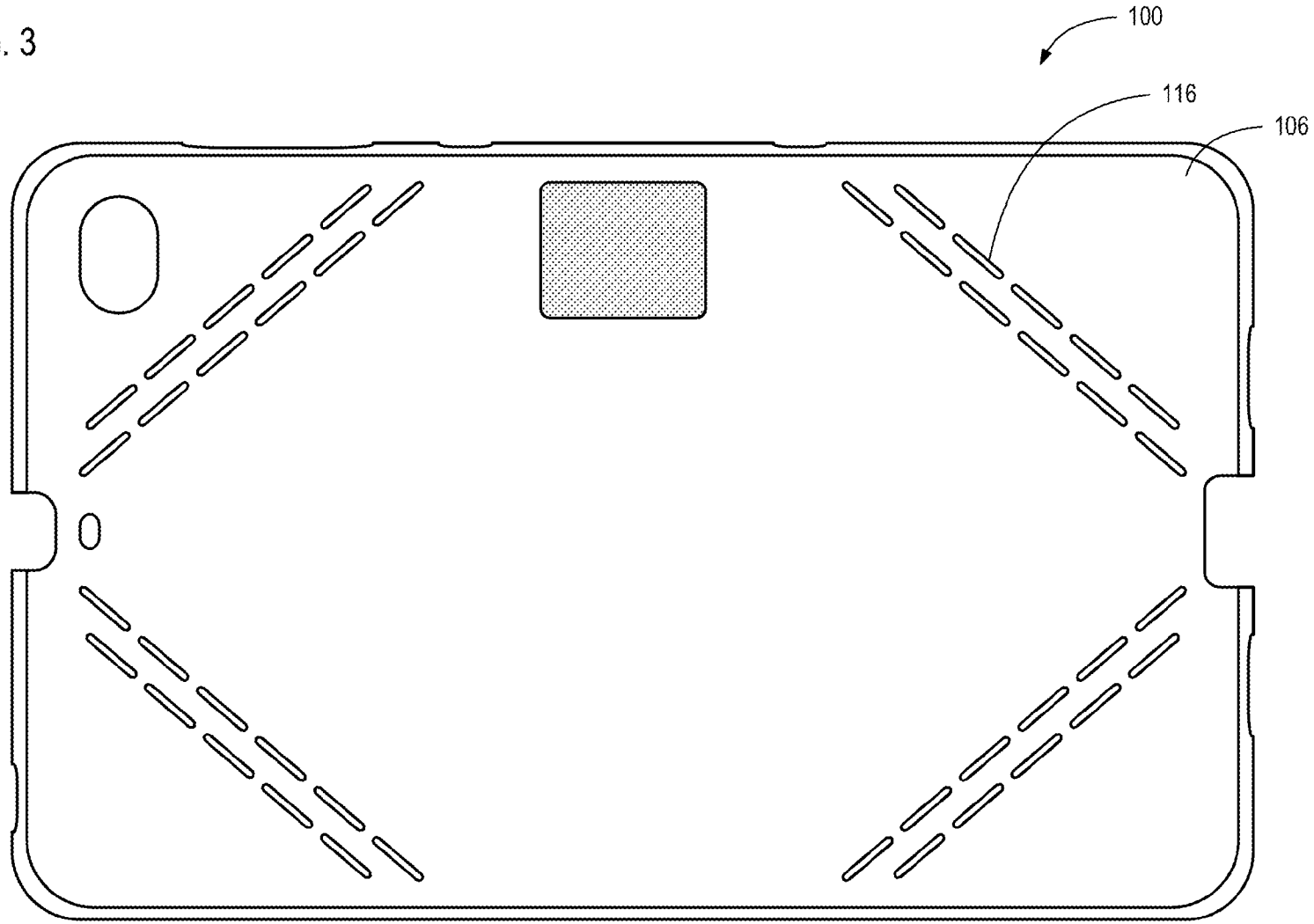
FIG. 3 is a front view of an embodiment of a case with extendable corners.
Figure 4:
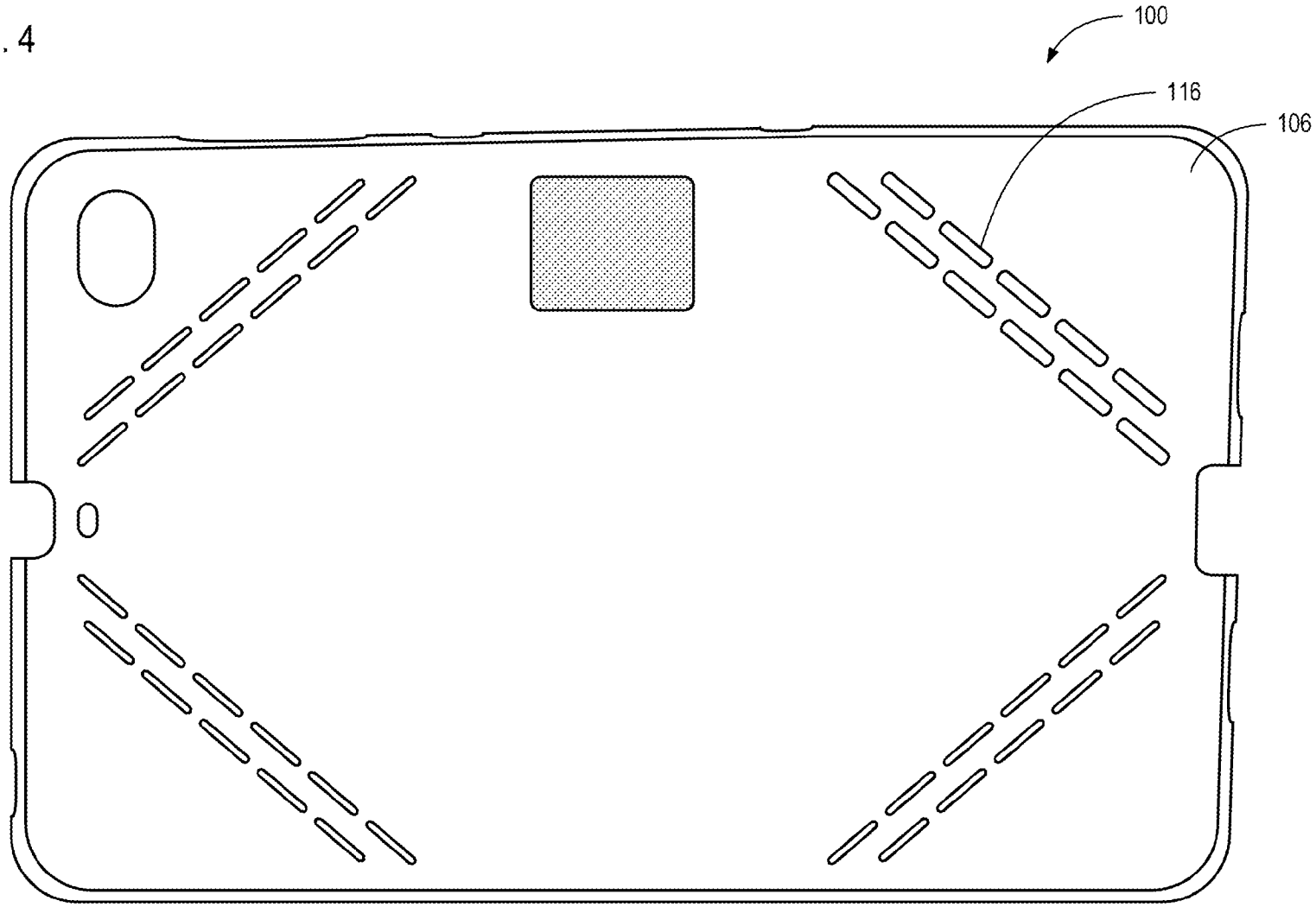
FIG. 4 is a front view of an embodiment of a case with one of the extendable corners slightly stretched.

FIGS. 3-4 illustrate various front views of an embodiment of the case 100 with extendable corners. As demonstrated, each corner (e.g., the corner 106) may extend between a contracted position, as shown in FIG. 3, and an extended position, as shown in FIG. 4. The corners may be extended by an exertion of physical force of the user, and may remain in the extended position if a PED is inserted in the case 100.

The discrete series of grooves may aid in allowing the corners to extend. As illustrated in FIG. 3, the discrete series of grooves 116 may be thin slits when the corner 106 is in a contracted position. As the user extends the corner 106, the discrete series of grooves 116 may expand as illustrated in FIG. 4. The discrete series of grooves 116 may cause the case 100 to be more flexible or stretchable along that area. Thus, much of the extending may be directly along the discrete series of grooves 116. In some embodiments the case 100 may be made of material that has a greater elasticity in order to allow the case 100 to extend even further.

This ability to extend may allow the case 100 to accommodate PEDs of different dimensions. Many PED manufactures in an attempt to improve their PED adjust different parameters of their PED when they introduce a new generation of the same PED. Often the physical dimensions are among those parameters that are adjusted. In these situations, the extended corners may allow the case 100 to fit both the original PED and the new generation PED. For example, the case 100 may be made with such dimensions that it fits a PED in the extended position. If the manufacturer were to release another PED that is slightly smaller, the case 100 may be able to fit that PED in its contracted position. Similarly, case 100 may be made with such dimensions that it fits a PED in the contracted position. If the manufacturer were to release another PED that is slightly larger, the case 100 may be able to fit that PED in its extended position.

Figure 5:
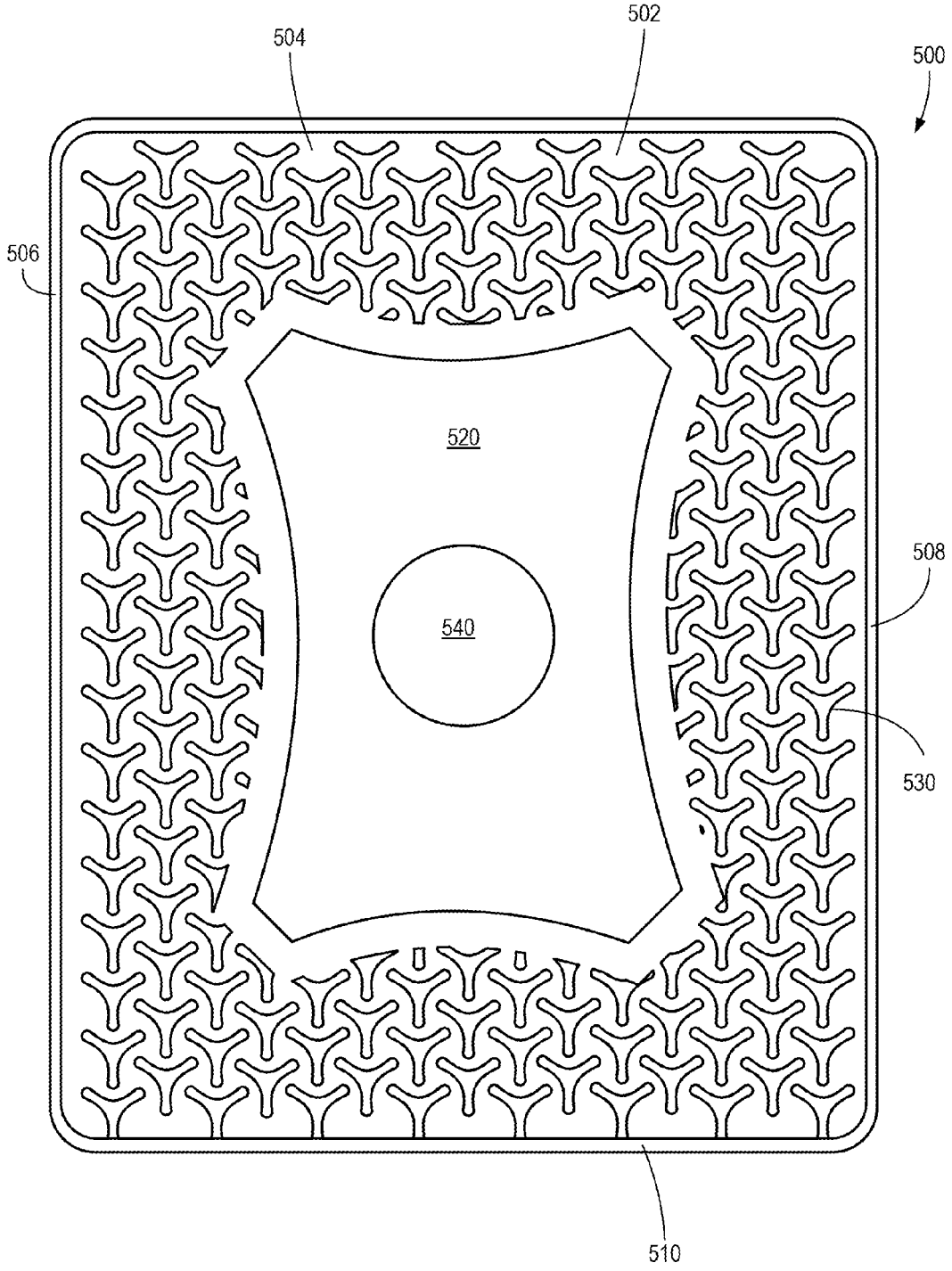
FIG. 5 is a top-down view of the outside of an embodiment of a case with a tessellated structure, according to one embodiment.

FIG. 5 is a top-down view of the outside of an embodiment of a case 500 with a tessellated structure. As shown in FIG. 5, the case 500 may have a rear wall 502 and four sidewalls 504, 506, 508, and 510 for partially or entirely encasing a PED. The case 500 may include a reinforcing member 520. FIG. 5 also shows the case 500 with a tessellation of apertures 530. The apertures 530 are embodied as a three-pointed start shape. The tessellation of apertures 530 in the case 500 may cover all or part of the case 500, including all or part of one or more of the rear wall 502 and four sidewalls 504, 506, 508, and 510, and may provide aesthetic appeal as well as increased flexibility and elasticity. This increased flexibility and elasticity may assist fitting PEDs of different sizes inside the case 500 as well as provide increased durability and/or longevity to the case 500. The case 500 secures and/or protects PEDs while the reinforcing member 520 may be stretchable to allow the reinforcing member 520 to expand or contract to selectively allow the case 500 to fit PEDs of varying sizes (e.g., PEDs of different product generations). In other embodiments, the reinforcing member 520 may not expand or contract but rather the tessellated body portion (which may include the rear wall 502 and the four sidewalls 504, 506, 508, and 510) of the case 500 may expand or contract to selectively allow the case 500 to fit PEDs of varying sizes. Thus, the case 500 may provide protection and/or support to PEDs with different dimensions by combing these elements. The case 500 may also include a center aperture 540 in the reinforcing member 520, which allows a user to view a PED in the case 500 from the backside of the case 500.

According to various embodiments, the case 500 may provide protection for an encased PED. Other embodiments may include ornamental features including but not limited to the tessellation of aperture 530 shown in FIG. 5, and may not even completely cover the backside of the PED. Yet other embodiments may have the reinforcing member 520 composed of materials with a high elasticity coefficient. The stretchable reinforcing member 520 may assist in accommodating PEDs of different sizes. Some embodiments may have a rear wall 502 and four opposing sidewalls 504, 506, 508, and 510, while other embodiments may have fewer than four sidewalls.

In some embodiments, the rear wall 502 and the opposing sidewalls 504, 506, 508, and 510 may be configured to elastically adjust in size and shape to fit PEDs of different sizes. For example, the rear wall 502 may be coupled to each of the four opposing sidewalls 504, 506, 508, and 510 that frictionally engage and secure a PED. The case 500 may be made partially or entirely of elastic material, thus accommodating PEDs of different sizes. Another embodiment may have tessellations like those shown in FIG. 5 within the body of the case 500 that allow for further elasticity and malleability as well as aesthetic appeal. The tessellations shown in FIGS. 5, 6A, 6B, and 7 are possible patterns that could be used, though any number of other patterns are also contemplated. In some embodiments the case 500 may be made of material that has a greater elasticity in order to allow the case 500 to extend even further.

This ability to extend may allow the case 500 to accommodate PEDs of different dimensions. Many PED manufacturers, in an attempt to improve their PEDs, adjust different parameters of their PED when they introduce a new generation of the same PED. Often the physical dimensions are among those parameters that are adjusted. In these situations, the expandable sidewalls 504, 506, 508, and 510 and/or elastic rear wall 502 may allow the case 500 to fit both the original PED and the new generation PED. For example, the case 500 may be made with such dimensions that it fits a PED in the extended position. If the manufacturer were to release another PED that is slightly smaller, the case 500 may be able to fit that PED in its contracted position. Similarly, the case 500 may be made with such dimensions that it fits a PED in the contracted position. If the manufacturer were to release another PED that is slightly larger, the case 500 may be able to fit that PED in its extended position.

The case 500 may be configured to secure a variety of different PEDs. The illustrated embodiment of the case 500 has a shape corresponding to a PED such that it engages the PED around its circumference to retain the PED in the case 500. Thus, the case 500 may use its sidewalls 504, 506, 508, and 510 and the reinforcing member 520 to secure a PED through a frictional engagement. Further, if the reinforcing member 520 has a high elasticity coefficient, the sidewalls 504, 506, 508, and 510 can have the ability to adjust position as the reinforcing member 520 stretches, to accommodate PEDs of different sizes. The case 500 may use other mechanisms to secure the device such as elastics, magnets, adhesives, etc. The case 500 may secure a PED such that the backside and edges of the PED are substantially protected.

In some embodiments, the case 500 may include a plurality of access points (not shown) for interacting with various elements of a PED. For example, the case 500 may include access points within one or more of the sidewalls 504, 506, 508, and 510, the reinforcing member 520, and/or the rear wall 502. These elements vary by PED and may include, but are not limited to, a camera, USB port, headphone jack, power button, and volume rocker. Further, these elements will vary in size and location on each different PED. Thus, the access points of the case 500 may be sized and/or positioned to allow for access to the elements of various PEDs of different dimensions, though not each PED will fit exactly the same.

Figure 6B:
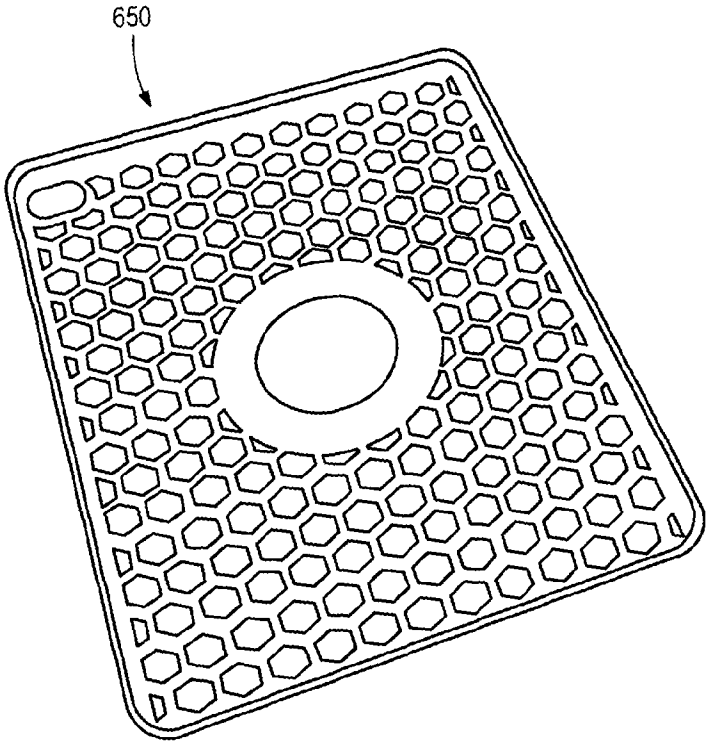
FIG. 6B is an angled top-down view of the inside of an embodiment of a case with a third tessellated structure, according to one embodiment.
Figure 6A:
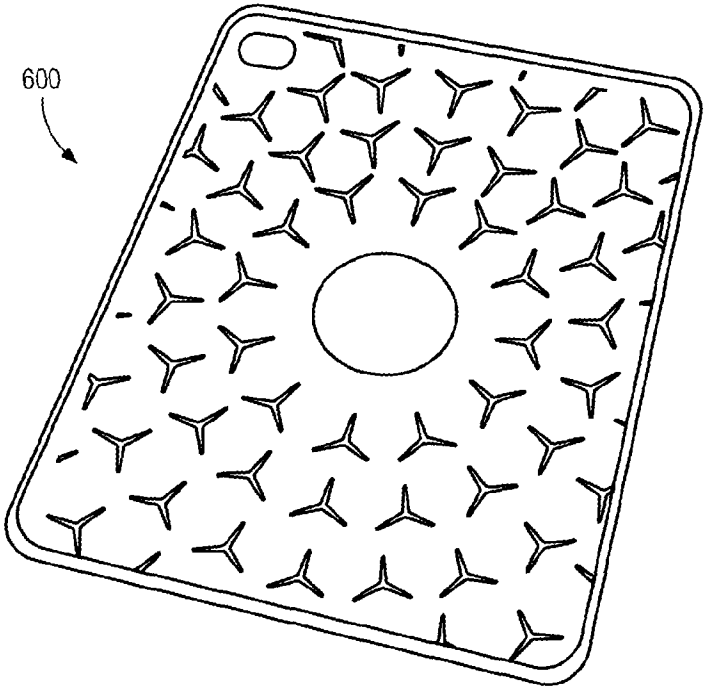
FIG. 6A is an angled top-down view of the inside of an embodiment of a case with a second tessellated structure, according to one embodiment.

FIG. 6A is an angled top-down view of the inside of an embodiment of a case 600 with a second tessellated structure, according to one embodiment. As shown in FIG. 6A, the case 600 may have a tessellation pattern using a three-pointed star shape with a wide spacing or sparse placement. The tessellations may occur in all or part of the rear wall 502 (FIG. 5), the reinforcing member 520 (FIG. 5), and/or the sidewalls 504, 506, 508, 510 (FIG. 5).

FIG. 6B is an angled top-down view of the inside of an embodiment of a case 650 with a third tessellated structure, according to one embodiment. FIG. 6B shows the case 650 with tessellations using a hexagonal pattern with a tighter spacing or dense placement. Different shapes, spacing, and/or densities of the tessellation patterns may provide for varying degrees of flexibility and/or elasticity of the case 650, thereby enabling the case 650 to fit PEDs of varying sizes.

It is noted that while only three patterns are depicted, various others are contemplated. Tessellations of different sizes, patterns, shapes, and spacing may provide varying degrees of flexibility and elasticity to assist fitting PEDs of different sizes and are within the scope of this description.

Figure 7:
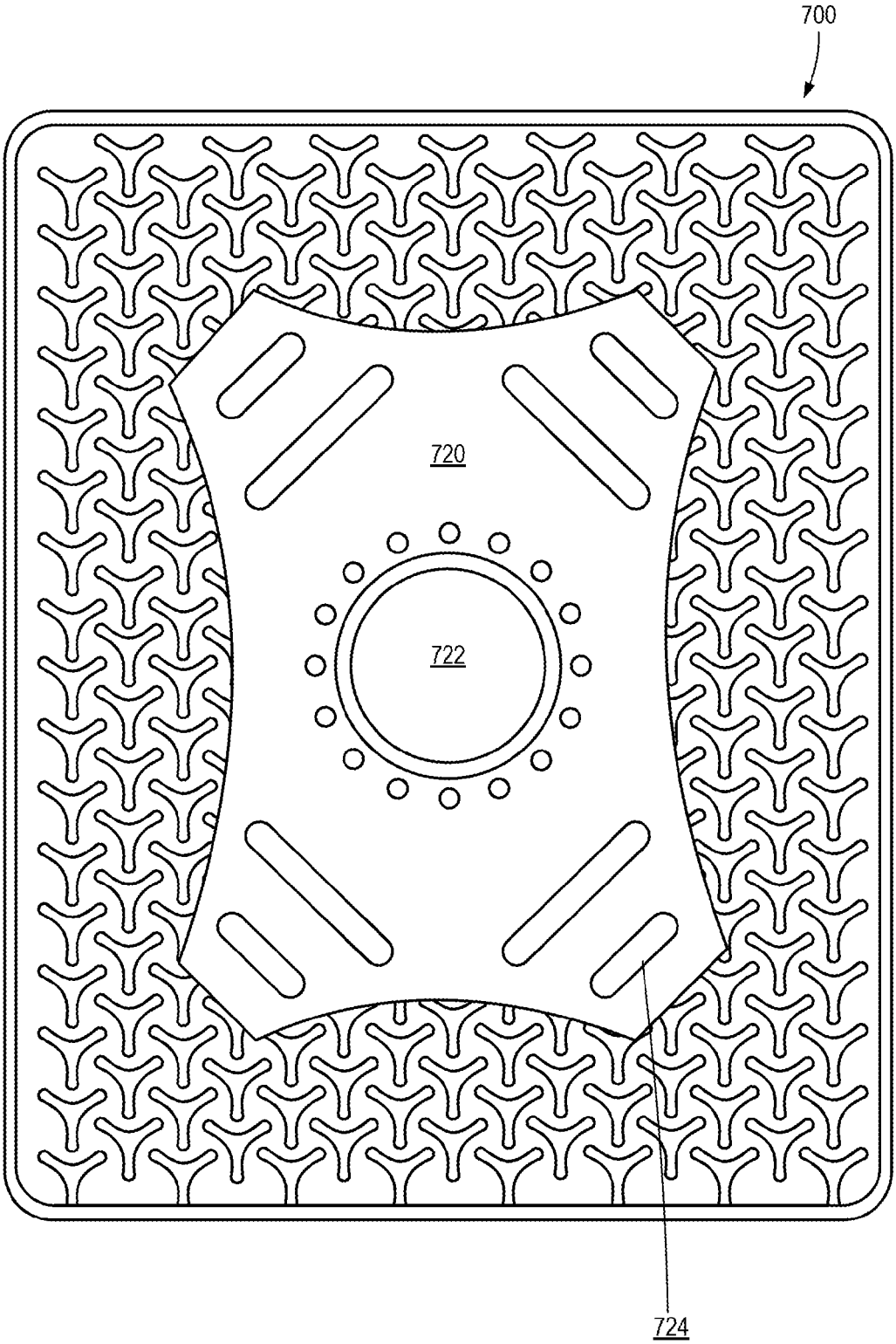
FIG. 7 is a top-down view of the inside of an embodiment of a case with a tessellated structure, according to one embodiment.

FIG. 7 is a top-down view of the inside of an embodiment of a case 700 with a tessellated structure, according to one embodiment. As shown, FIG. 7 illustrates an embodiment of the case 700 having a closely fit tessellation pattern using a three-pointed star shape. Also shown in FIG. 7 is a reinforcing member 720 with one possible design, though various other designs incorporating any number of different shapes and features are also contemplated. The reinforcing member 720 may be stretchable and disposed to render one or more tessellations incomplete. The reinforcing member 720 may include a center aperture 722 to allow a user to view the PED from a backside of the case 700 while the PED is in the case 700. The reinforcing member 720 may include one or more apertures 724 to facilitate stretching of the reinforcing member 720.

The above description provides numerous specific details for a thorough understanding of the embodiments described herein. However, those of skill in the art will recognize that one or more of the specific details may be omitted, or other methods, components, or materials may be used. In some cases, operations are not shown or described in detail. Additionally, features or elements described in conjunction with any one embodiment may be adapted for use with and/or combined with the features of any other embodiment.

What is claimed:

1. A case for a portable electronic device, the case comprising:

a rear wall configured to expand to accommodate portable electronic devices of different size, the rear wall including four corners, the rear wall including, an elastic portion having a tessellated pattern of unobstructed apertures extending over the majority of the elastic portion to provide elasticity to the case, and a reinforcing member including a material less elastic than the elastic portion, the reinforcing member surrounded by the elastic portion and permanently attached to the elastic portion along a perimeter of the reinforcing member; and a plurality of stretchable opposing sidewalls coupled to the rear wall, wherein the sidewalls and the rear wall are configured in size and shape to frictionally engage and retain a portable electronic device.

2. The case of claim 1, wherein the apertures are disposed equidistant from one another.

3. The case of claim 1, wherein the reinforcing member is configured to elastically expand to accommodate a portable electronic device.

4. The case of claim 3, wherein the reinforcing member includes a plurality of apertures extending through the rear wall and configured to enable the case to expand.

5. The case of claim 1, wherein the reinforcing member further comprises a center aperture extending through the rear wall.

6. The case of claim 1, wherein the tessellated pattern of unobstructed apertures extends over the majority of the rear wall.

7. The case of claim 1, wherein the reinforcing member is substantially inelastic.

8. A case for a portable electronic device, the case comprising:

a rear wall configured to expand to accommodate portable electronic devices of different size, the rear wall including four corners, the rear wall including, an elastic portion having a tessellated pattern of unobstructed apertures extending over the majority of the elastic portion to provide elasticity to the case, a reinforcing member including a substantially rigid material, the reinforcing member surrounded by the elastic portion and permanently attached to the elastic portion along a perimeter of the reinforcing member, and a center aperture extending through the rear wall; and a plurality of stretchable opposing sidewalls coupled to the rear wall, wherein the sidewalls and the rear wall are configured in size and shape to frictionally engage and retain a portable electronic device.

9. The case of claim 8, wherein the apertures are disposed equidistant from one another.

10. The case of claim 8, wherein the tessellated pattern of unobstructed apertures extends over the majority of the rear wall.

11. The case of claim 8, wherein sidewalls include sidewall apertures to enable access to the portable electronic device.

* * * * *